US006231411B1

(12) United States Patent
Vinay

(10) Patent No.: US 6,231,411 B1
(45) Date of Patent: May 15, 2001

(54) FASHIONABLE EMERGENCY FLOTATION AID

(76) Inventor: Alejandro Vinay, Prol. Bosques de Reforma #2000-120., Mexico City, D.F. (MX)

( * ) Notice: Subject to any disclaimer, the term of this patent is extended or adjusted under 35 U.S.C. 154(b) by 0 days.

(21) Appl. No.: 09/578,104

(22) Filed: May 24, 2000

(51) Int. Cl.[7] ..... B63C 9/08
(52) U.S. Cl. ..... 441/120; 441/88
(58) Field of Search ..... 441/88, 99, 102, 441/108, 113, 120

(56) References Cited

U.S. PATENT DOCUMENTS

| | | | | |
|---|---|---|---|---|
| 262,703 | | 8/1882 | Sibley . | |
| 1,138,495 | | 5/1915 | Macaulay . | |
| 1,704,197 | | 3/1929 | Journey . | |
| 2,490,556 | * | 12/1949 | Spack | 441/120 |
| 2,615,182 | * | 10/1952 | Podell | 441/113 |
| 3,104,403 | | 9/1963 | Lortz . | |
| 3,134,993 | * | 6/1964 | McCoy | 441/102 |
| 3,148,393 | | 9/1964 | McCuaig . | |
| 3,199,128 | | 8/1965 | Nojd . | |
| 3,681,800 | | 8/1972 | Thoma . | |
| 3,935,608 | | 2/1976 | Freedman et al. . | |
| 3,952,355 | | 4/1976 | Bardebes . | |
| 4,379,705 | | 4/1983 | Saotome | 441/94 |
| 4,626,221 | | 12/1986 | Rocco | 441/108 |
| 4,685,890 | | 8/1987 | Edwards | 441/94 |
| 4,767,371 | | 8/1988 | Jackson | 441/94 |
| 5,037,341 | | 8/1991 | Howard | 441/89 |
| 5,178,569 | | 1/1993 | Wang | 441/93 |
| 5,382,184 | | 1/1995 | DiForte, Jr. | 441/108 |
| 5,456,623 | | 10/1995 | Norris | 441/92 |
| 5,466,179 | | 11/1995 | Jeffrey, Sr. | 441/108 |
| 5,685,752 | | 11/1997 | Fulton, Jr. | 441/90 |
| 5,746,632 | | 5/1998 | Theberge | 441/115 |
| 5,839,932 | | 11/1998 | Pierce et al. | 441/8 |
| 5,954,556 | | 9/1999 | Powers | 441/88 |

* cited by examiner

*Primary Examiner*—Jesus D. Sotelo
(74) *Attorney, Agent, or Firm*—Pillsbury Winthrop LLP

(57) ABSTRACT

A fashionable life saving device utilizes the look of casual clothing such as shorts, pants, bathing suits or skorts to disguise inflatable chambers, a gas canister and safety devices including a manual inflation tube, thereby providing a subtle way to ensure safety in and around the water. When inflated, the chambers rest under the users arms, but are safely attached to his waist or the lower part of his body for security and safety.

24 Claims, 10 Drawing Sheets

FASHIONABLE EMERGENCY FLOTATION AID

BACKGROUND OF THE INVENTION

The present invention relates to the field of inflatable safety devices that may be worn by men and women with or as articles of clothing, and more particularly to a flotation device that may be manually activated to release an inflatable element which is designed to rest around the torso and under the arms of the user when inflated while remaining anchored at the waist.

There are many devices known in the art for use in the water that provide flotational assistance to the user. A large proportion of personal flotational devices in use today are designed to be separate from a person's bathing suit. Some are made of bulky flotational materials, while others must be inflated by one's breath or by an external pump. Still others incorporate compressed air canisters. Many of these devices, while providing a large amount of flotational support, are bulky and too unwieldy to carry while performing basic tasks or engaging in water sports.

Many people die each year by drowning. In 1997 alone, more than 4,050 people drowned in the United States. Drowning may be caused by cramps or by exhaustion. Exhaustion can be brought about by swimming too long or far or by performing other activities that cause exhaustion. Other deaths occur when people are caught in rip tides or are involved in boating accidents. The common factor in all of these is the inability of a person to keep their face above water. While people may know of the risk of drowning, many do not take flotational devices with them that may keep them afloat before they enter the water or begin activities near the water.

U.S. Pat. No. 3,935,608, to Freedman et al. (the "'608 patent"), is directed to an article of clothing having a pocket portion containing an inflatable envelope and a compressed fluid container for inflating the envelope whereby, upon inflation, the envelope is forced out of the pocket portion and serves to provide flotational support to the user. The compressed fluid canister of the '608 patent is located at the user's back. See FIGS. 2 and 3. There is a means on the fluid container for actuation to release the fluid therefrom and inflate the envelope. See Claim 1.

The device of '608 patent has several disadvantages. First, the location of the fluid canister of the device is unwieldy; users may not have the time or presence of mind in an emergency situation to reach behind themselves and activate a buoyancy device. Secondly, the envelope of the device "may be deflated by simply unscrewing the screw from the insert." Col. 2, L. 13–14. Given that the invention of the '608 patent is designed to be worn as an article of clothing and generally only activated during times of emergency, it may be worn frequently or for long periods of time without being activated. Further, it may be moved, dropped or jostled. The invention of the '608 patent will probably also experience vibrations from a car or boat motor. All of these could serve to loosen the screw which is the seal between the air inside the envelope and the environment. As such, there is a substantial risk that the invention may fail when called upon to provide flotational support during an emergency. Further, since the user has access to the screw, human error in replacing the screw may cause a malfunction during an emergency.

U.S. Pat. No. 5,954,556, to Powers, (the "'556" patent), is directed to an inflatable life saving belt comprising a gas source that is linked to reusable inflatable bags at multiple locations on the belt. The gas source of the invention of the '556 patent may include pressurized vinegar and baking soda or pressurized gas. The belt is worn around the waist of the user. The inflatable chambers which are spaced around the belt are attached thereto. This life saving belt does not provide for a means to release the inflated portion from the waist of the user or expand the belt such that it will rest around the upper portion of the torso.

Since the inflated chambers remain at the user's waist, the flotational support provided by the invention of the '556 patent would be awkward and unwieldy. The user would continuously have to tread water or swim in order to keep his head above water. An additional risk that may be caused by this type of support is that uneven inflation caused by malfunction of the chambers may cause the wearer to tilt so that his head is under water. Further, given that the support comes from around the waist or lower torso, the invention of the '556 patent is not suitable for the support of an injured or tired user. One who is injured or tired needs a device that will hold their head above water without any energy being expended by the user.

The vast majority of devices in this field which utilize canisters of compressed gas fail to recognize an obvious safety concern: rupturing of the canister. Pressurized canisters can rupture when struck with an appropriate amount of force. Generally, canisters associated with inflatable devices are located about the torso of the individual. In an emergency situation, the user may be falling into the water or onto debris that are in the water (if a boat capsized, for example). If the canister were to be between the user and the water or a hard object, it would be subjected to a forceful blow. In some situations, this or other forceful blows could cause the canister to rupture. Given that most of a human's vital organs are located in the torso, locating the canister around the torso of the user is an ill-advised risk.

These same inventions also fail to recognize that having a canister pressing into the wearer's back or torso is uncomfortable, especially when sitting or lounging in the sun, as many do while near the water.

There is a need for a flotational device that minimizes the potential for harm from compressed air canisters and incorporates safety features that is comfortable, fashionable and that may be worn inconspicuously by the user such that it does not interfere with the user's normal activities, both above the water, below the water and on land, and which may be activated when the user so desires.

SUMMARY OF THE INVENTION

An object of the present invention is to provide a flotation device that may be used to prevent accidental deaths by drowning.

Another object of the present invention is to provide a flotation device that is fashionable.

Another object of the present invention is to provide a flotation device that may be both manually and automatically inflated.

Another object of the present invention is to provide a flotation device that will not interfere with the wearer's activities.

Another object of the present invention is to provide a flotation device that may be subtly worn.

Another object of the present invention is to provide a flotation device that may be worn comfortably.

Another object of the present invention is to provide a flotation device that may inflate quickly upon the pulling of a ripcord which is conveniently located.

Another object of the present invention is to provide a flotation device that has a ripcord which is readily accessible and within the user's easy reach.

Another object of the present invention is to provide an automatically inflating device that minimizes the risks associated with the use of compresses gas canisters.

Accordingly, the above problems and difficulties are obviated by the present invention, which provides a fashionable device that is easily inflatable upon demand and which may be worn inconspicuously by the user such that it does not interfere with the user's activities, both above and below the water.

One embodiment of the present invention includes two inflatable chambers, straps for holding the chambers to the lower portion of the invention, a rip cord, a compressed gas canister, a manual inflation tube and an article of apparel which serves to carry the other elements of the invention in an aesthetic manner that does not compromise its effectiveness.

BRIEF DESCRIPTION OF THE DRAWINGS

FIG. 1(*c*) illustrates a safety feature of the present invention: the safeguard.

FIG. 2(*b*) illustrates the pocket for the compressed gas canister.

FIG. 2(*c*) provides a deflated view of the present invention.

FIG. 4(*b*) provides an illustration of the manual inflation portion of the present invention.

FIG. 4(*c*) provides an illustration of the whistle and manual inflation mouthpiece of the present invention in their sealed form.

DESCRIPTION OF THE PREFERRED EMBODIMENTS

Figure 1A:
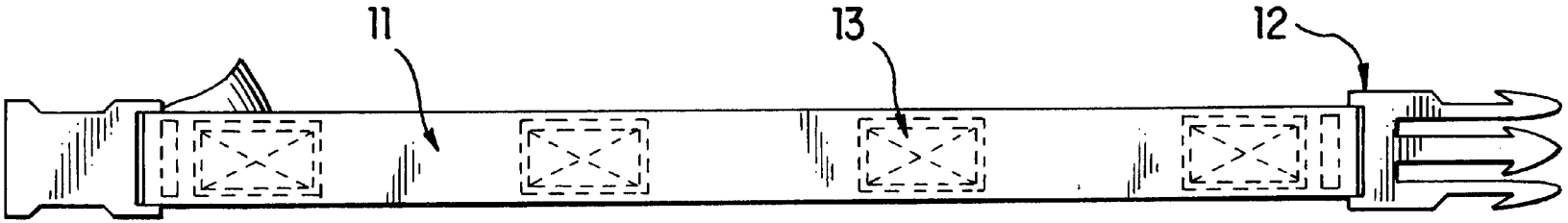
FIGS. 1(*a*) and 1(*b*) illustrate the waist strap of the present invention.
Figure 1B:
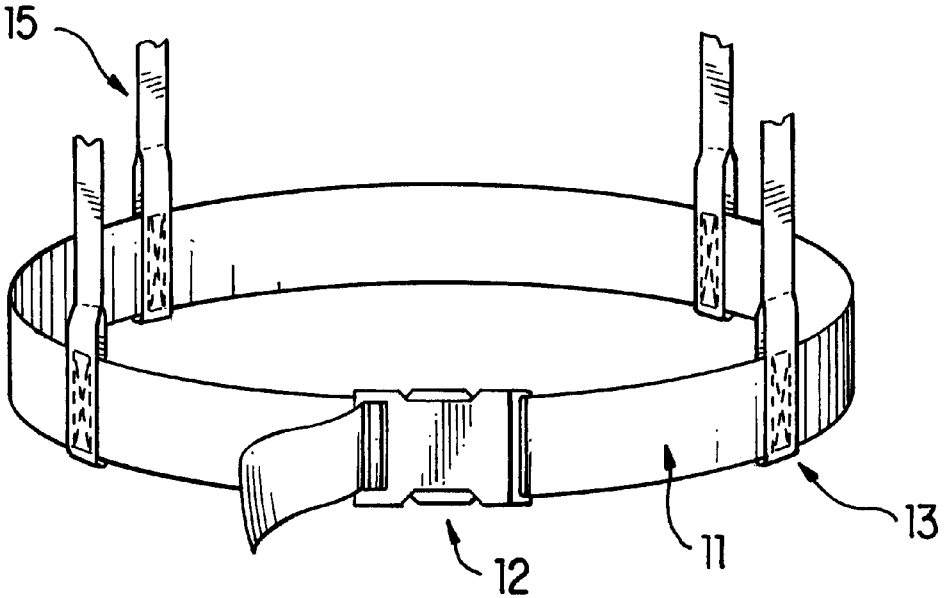
Figure 1C:
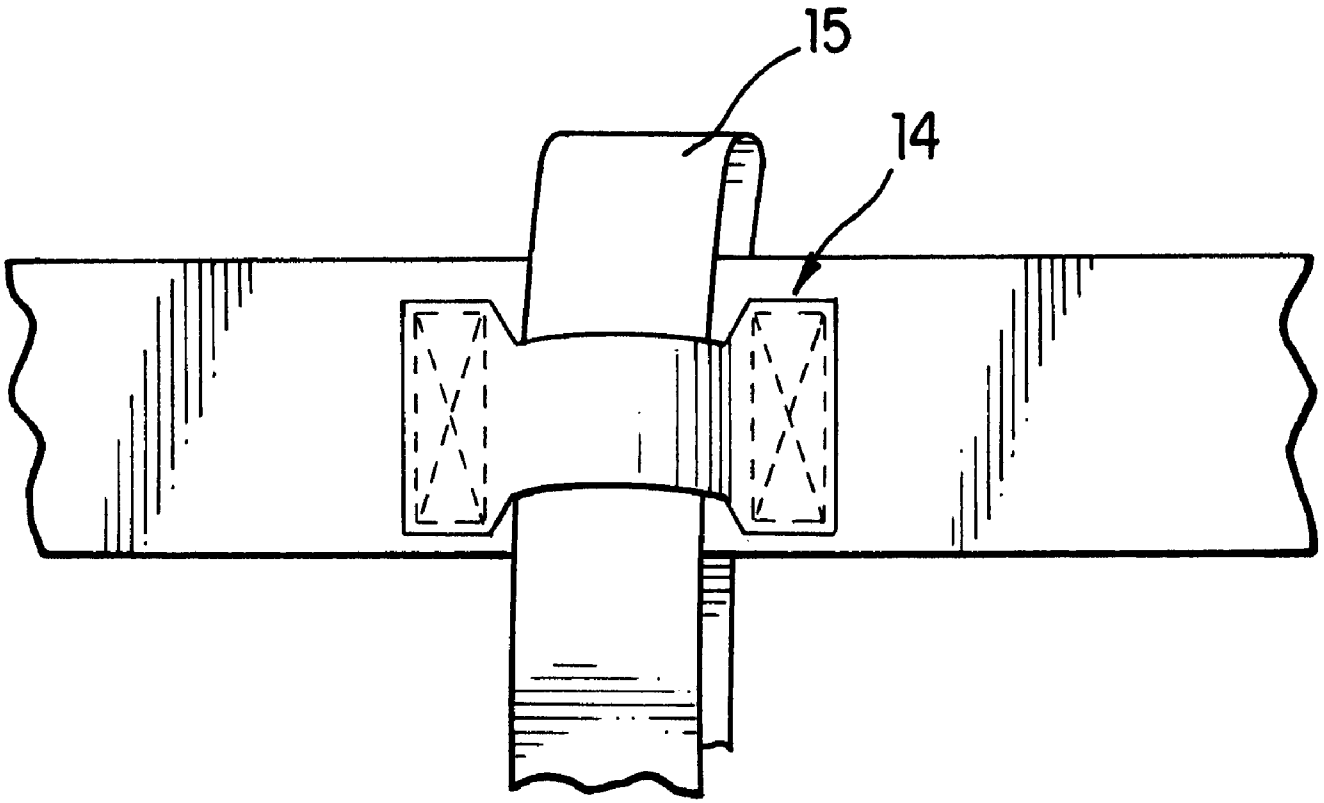

FIG. 1(*a*) provides a view of the waist strap or belt-like portion 11 as would be worn by the user to firmly secure the present invention to the user's waist. This may be generally located inside the envelope portion 19 of the invention. The belt 11 is constructed of strong yet lightweight material, such as nylon. While materials recommended by the U.S. Coast Guard are preferable, any material that is strong and lightweight is appropriate. The belt has a buckle 12 that may be designed to make a clicking or snapping noise when closed. As shown in FIG. 1(*b*), the belt 11 may be adjustable so that it can be made to fit different waist sizes.

FIG. 1(*b*) provides a view of one embodiment of the belt or waist portion of the present invention when the inflatable chambers are inflated. The straps 15 are attached to the belt 11 at 13 and extend upwards towards the inflated chambers 32. The straps may be attached by heat welding, glue, stitching, or any other appropriate method. In an alternate embodiment of the present invention, the straps are attached by the use of safeguards 14. See FIG. 1(*c*). A safeguard 14 is a piece of nylon, canvas or other strong suitable material that is attached to the belt and/or inflatable chamber that ensures that, should the straps 15 become separated from their attached area, they remain in their appropriate spacing around the invention.

A safeguard 14 is generally attached to the desired surface at two ends, with an open space in between the ends through which a strap 5 may move. These safeguards also ensure that the personal flotation device will be more securely fastened to the belt. On the inflatable chambers, the safeguards may be located on the side of the chamber closest to the wearer's chest and on the side that is open to the air.

Figure 2A:
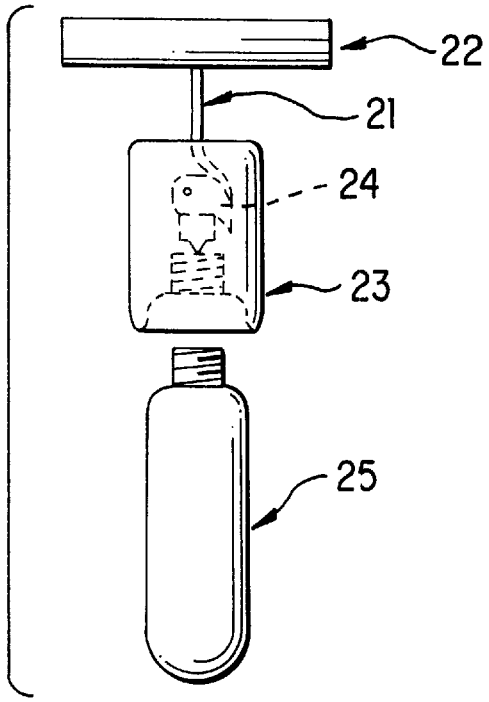
FIG. 2(*a*) provides a view of the automatic inflating apparatus of the present invention.
Figure 2B:
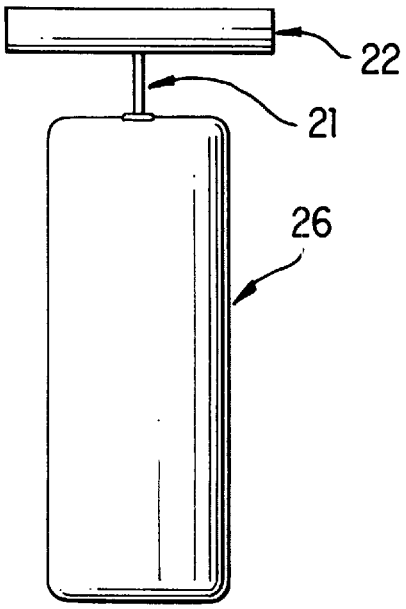
Figure 2C:
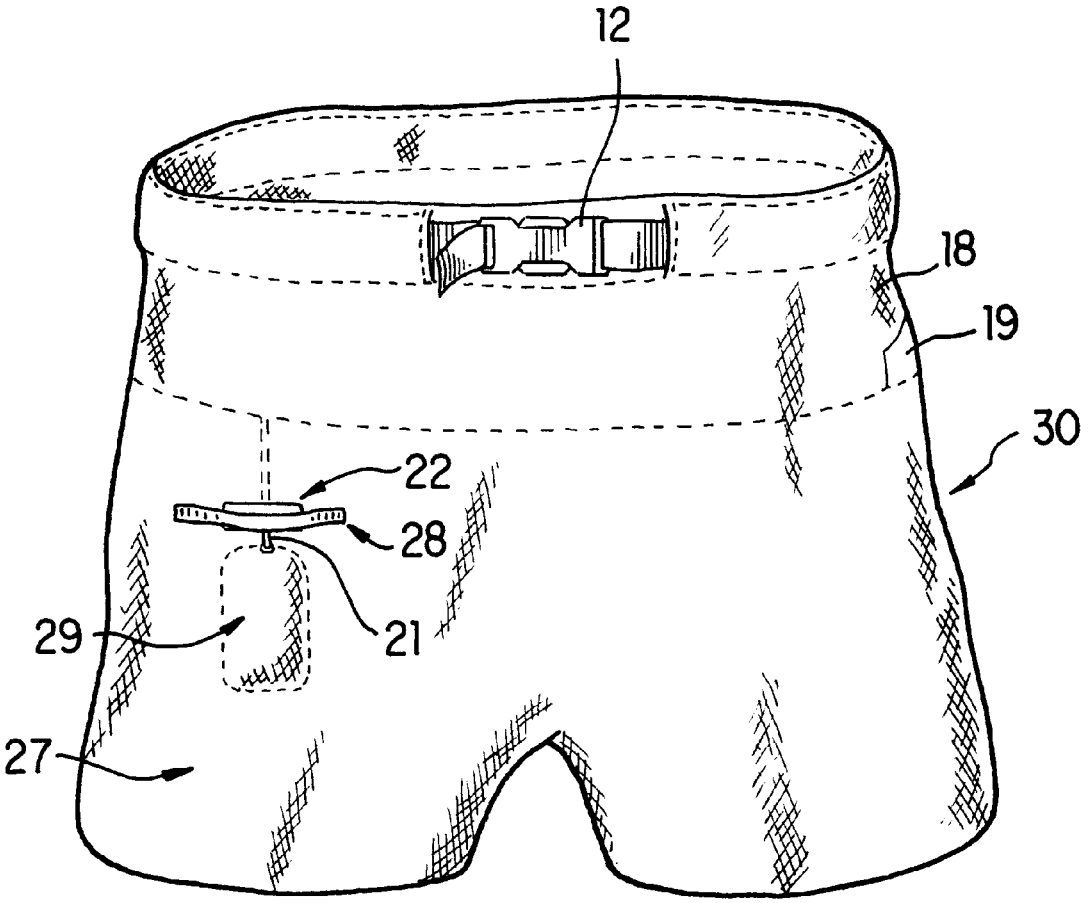

FIG. 2(*a*) provides a view of the compressed gas canister and ripcord mechanism. The ripcord 21 is depicted as having a handle 22 that is in the form of a rectangle. It should be understood that any shape which is easily grabbed, such as a ball or bar, would be appropriate for the handle. The ripcord 21 may be made of any durable material. The cartridge mechanism 24 which releases gas from the canister when the ripcord is pulled may be any such mechanism as is known in the art. The cartridge mechanism 24 is protected by a durable hard or semi-hard cover 23. The compressed gas cartridge 25 may be secured by screwing it to the cartridge mechanism 24.

Referring now to FIG. 2(*b*), a portion of the ripcord 21 and the handle 22 stay on the exterior of the bathing suit so that the inflating device is readily accessible to the user. The compressed gas cartridge, mechanism and cover (not shown) are encased in a durable casing 26 as protection. This helps to ensure that the present invention will remain operative regardless of the activities in which the user engages prior to activating the inflation mechanism. This casing will protect both: (1) the gas canister against blows that could cause rupturing and (2) the user, should the canister rupture or explode.

FIG. 2(*c*) provides a view of an embodiment of the present invention in its deflated state. In this embodiment, the invention resembles a pair of men's shorts or swim trunks. The inflatable chambers 32 (not shown) are enclosed in the envelope portion 19 of the shorts 30. This portion of the invention which resembles an article of clothing 30 will be referred to as the body of the invention. The phrase "the lower portion of the invention" refers generally to the body of the invention and the elements and area associated therewith. Upon inflation, the chambers 32 expand rapidly, thereby exiting the body of the invention 30 through the flap 18 of the envelope portion 19 by breaking the stitching, opening corresponding hook and loop fasteners such as Velcro®, or by opening or breaking a similar closure. FIG. 2(*c*) also shows the ripcord 21, the handle 22, and the pocket 29 enclosing the compressed gas cartridge 25 and mechanism 24 on the leg portion 27. While the ripcord and handle are depicted as being located at the waist side of the compressed gas canister, it should be understood that the automatic inflation device could be inverted.

FIG. 2(*c*) also shows that the handle 22 that is attached to the exposed portion of the ripcord 21 is held to the leg portion of the invention 27 by a strap 28 that lies over the handle. The strap 28 ensures that the ripcord 21 and handle 22 remain on the exterior of the invention and within easy reach of the user. The strap 28 may be any piece of cloth or other material. The strap 28 is attached to the leg portion 27 of the current invention by means of stitching, corresponding hook and loop fasteners such as Velcro® or other fastening means that are strong, but easily releasable. The strap 28 will prevent the ripcord from being pulled accidentally. Ripcord 21 extends from handle 22 into pocket 29, where it is connected to the cartridge mechanism 24 (not shown). Pocket 29, which is not accessible to the user, encloses the compressed gas cartridge, mechanism and casing, thus concealing them from the casual observer. Further, this prevents the compressed gas cartridge, mechanism and casing from moving excessively.

FIG. 2(*c*) additionally shows that the belt 11 may be incorporated into the shorts 30 of one embodiment of the present invention. The buckle 12 may be seen as located on the exterior of the invention and accessible to the user at all times through a hole in the 'flap' 18 of the envelope 19. While not shown, the belt 11 extends from the buckle 12 and is located within the envelope portion. In this embodiment, inflatable chambers (not shown) are located in the envelope 19 that is formed in the upper portion of the shorts. The chambers 32 are rolled so that they push out against the 'flap' 18 of the envelope 19 as the gas enters them. This pressure causes flap 18 to separate from the envelope portion 19 of the shorts in the area of the dotted line. In this way, the flap will be separated on one edge and the inflatable chambers will be released so that they may float to rest under the user's arms.

It should be understood that, while FIG. 2(*c*) depicts the present invention as being a pair of man's shorts, the invention may also take the form of a man's swimsuit, a woman's one-piece bathing suit, a bikini, a swimsuit, a wetsuit, a drysuit, shorts, pants, or shorts that are designed to resemble skirts (skorts).

Figure 3:
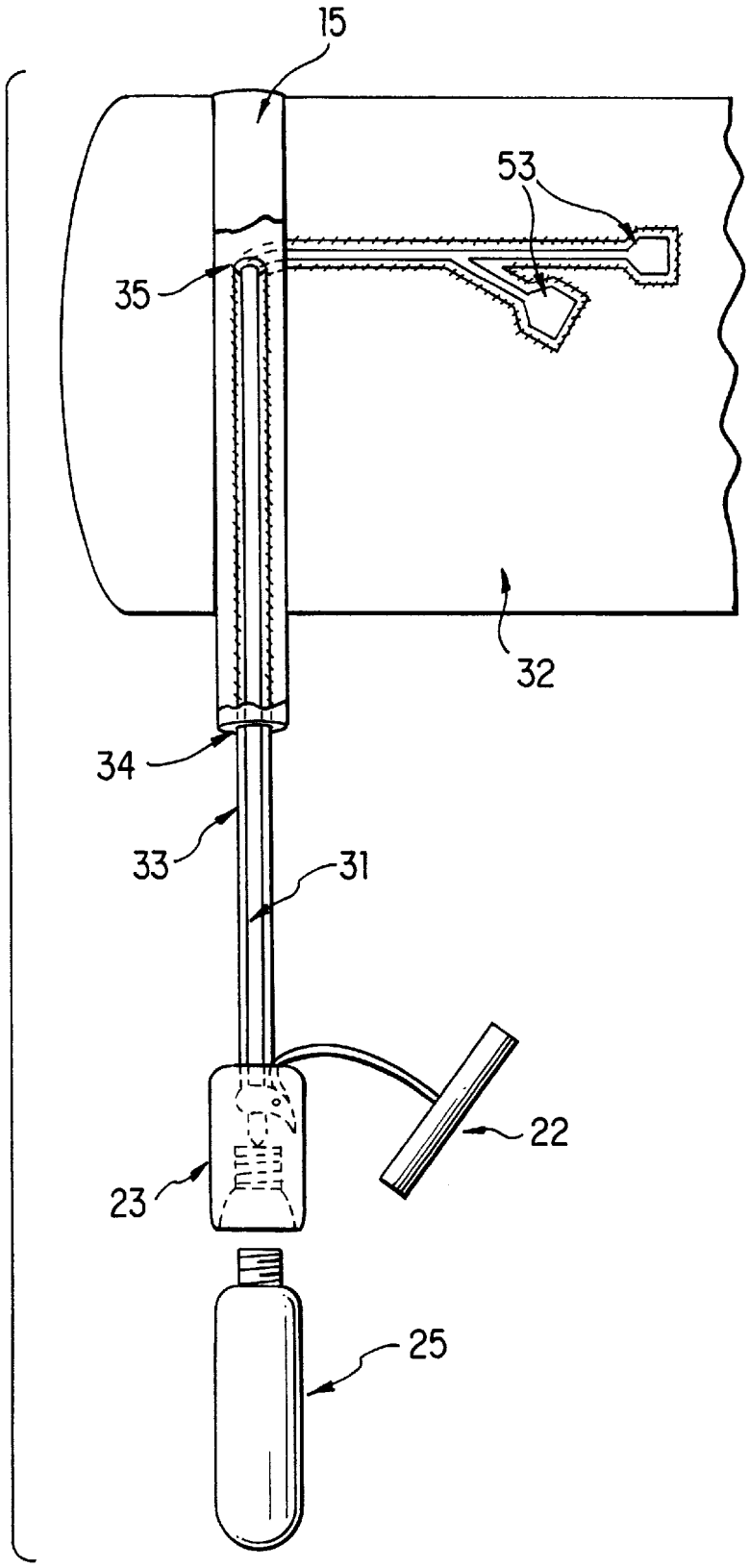
FIG. 3 illustrates the automatic inflating portion of the invention.

FIG. 3 illustrates the automatic inflating portion of the invention. The compressed gas cartridge 25 is attached to an inflating gas tube 31 that runs along the straps 15 (for simplicity, the belt is not shown in this figure) that hold the inflatable portion 32 of the present invention to the belt or waist portion 11. In an alternate embodiment of the present invention, the straps 15 may hold the inflatable chambers to the portion 30 of the present invention that resembles an article of clothing. When the compressed gas cartridge 25 is activated by the ripcord 21, gas quickly flows out of the cartridge, through the inflating tube 31 and into the inflatable portion of the present invention 32. A partially cut-away view is shown so that it may be seen how inflating tube 31, protecting tube 32 and strap 15 may fit together.

In FIG. 3, the inflating gas tube 31 is encased by a second tube 33 which is generally slightly larger and stronger that provides protection from any damage which may be caused by water activity. The second tube 33 may be made out of nylon, plastic or other strong, flexible material. The inflating gas tube 31 and the protective tube 33 meet an inflatable chamber 32 through a one-way airtight valve 35 that prevents gas from traveling back out of the airtight system of the present invention once the user has activated the gas canister.

In one embodiment of the present invention, the strap 15 has an interior hollow portion through which the gas tube 31 and protective tube 33 could travel to the inflatable portion 32. In this embodiment, there is an entrance hole 34 where the gas tube enters the strap near the waist area and an exit hole 35 where the gas tube exits the strap near the inflatable chamber area. In another embodiment, the gas tube 31 and protective tube 33 run from the compressed gas canister to the inflatable portions 32 following a route that is substantially parallel to the straps. In yet another embodiment, the protective tube 33 is attached to the strap 15 by stitching (shown in FIG. 3 with hash marks), heat welding, glue or the like.

Figure 4A:
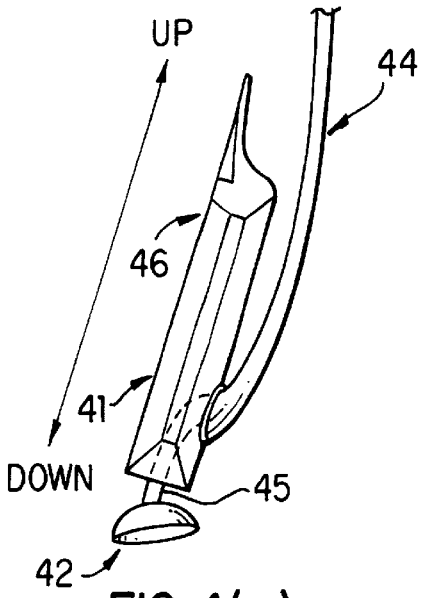
FIG. 4(*a*) provides an illustration of the whistle and mouthpiece features of the present invention.
Figure 4B:
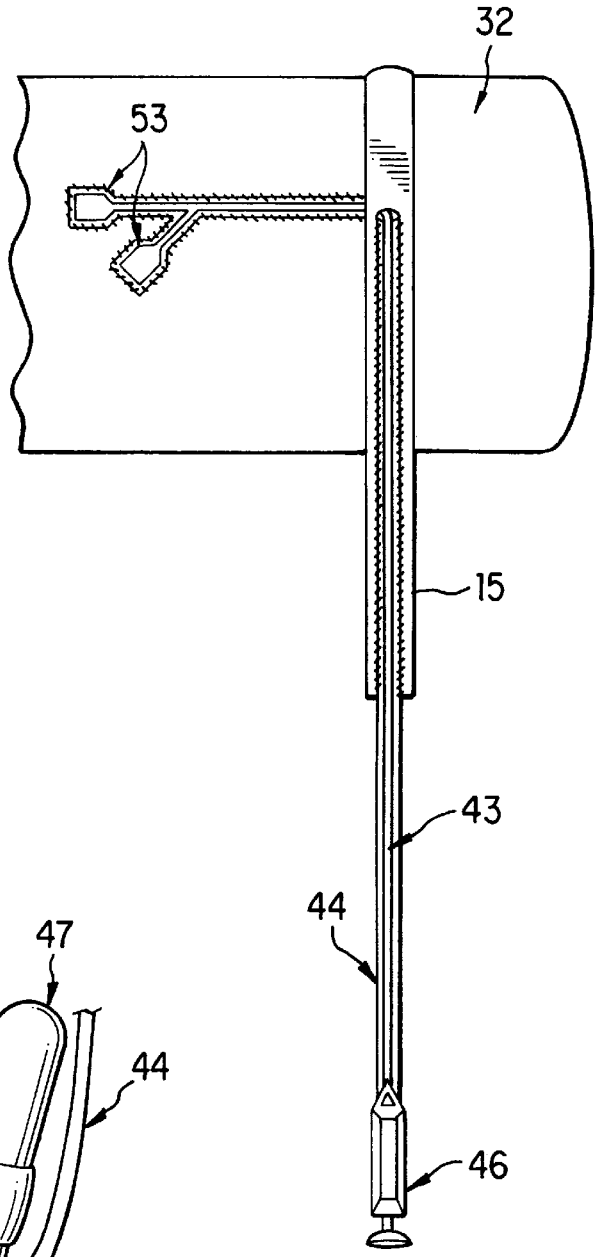
Figure 4C:
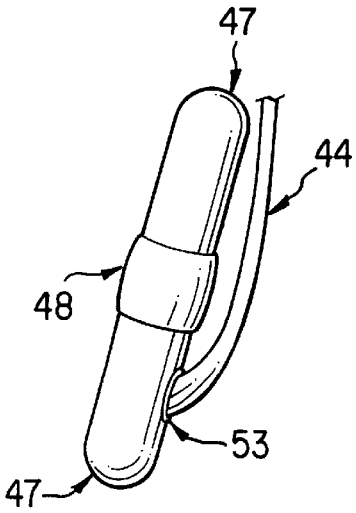

FIG. 4(*a*) provides another illustration of the manual inflation and whistle features of the present invention. There is a manual inflating attachment 41 that includes a mouthpiece 42. This permits the user to inflate a potentially malfunctioning inflatable chamber by means of blowing air through the mouthpiece 42.

The mouthpiece 42 is connected to an air tube 43 that is encased by a slightly larger and stronger second tube 44 which protection the air tube 43, particularly from water activity. The second tube may be made out of nylon, plastic or other strong, flexible material. The air tube 43 and its protective tube 44 should be long enough so that the mouthpiece 42 may easily reach the wearer's mouth. This may be accomplished by including additional tube length in the envelope 19.

The manual inflating attachment 41 has a one-way valve 45 located in close proximity to the mouthpiece 42 that prevents air from traveling back out of the airtight system of the present invention once the user has caused it to enter the system by breathing into the mouthpiece 42 of the manual inflating attachment 41. The valve 45 also ensures that air remains in the tube 43 after the wearer has used the manual inflating attachment 41. This ensures that the air tube will float in the water within easy reach of the user in case it is needed a second time.

FIG. 4(*a*) also illustrates a whistle 46 directed in an opposite direction to the manual inflating mouthpiece 42. In a preferred embodiment of the present invention, the whistle mouthpiece 47 points "up" towards the user's torso and the oral inflation mouthpiece 42 points "down" towards the user's feet when attached at the user's leg. This orientation permits easier access to the manual inflatable valve when necessary. The inflation mouthpiece/whistle combination may be attached or secured to the leg portion 55 of the present invention by means of stitching, corresponding hook and loop fasteners such as Velcro® or other fastening means that are strong, but easily releasable.

FIG. 4(*b*) illustrates how the manual inflating portion and the whistle are connected to the inflatable chambers 32. The manual inflating attachment is connected to the chambers by means of an air tube 43 that runs substantially parallel to the straps that hold the inflatable portion of the present invention to the belt-like portion of the present invention. The air tube 43 is contained inside a protective tube 44. As with the gas tube 31 the air tube and its protective tube may be attached to or run along or inside the straps 15 of the present invention. Attachment to the strap may be achieved by way of stitching (shown in FIG. 4(*b*) with hash marks), heat welding or other means sufficient to hold the tube 44 to the strap 15 and prevent separation of the two.

As further demonstrated in FIG. 4(*b*), the air tube branches before reaching the chambers so that each chamber has its own supply of air. The protective tube 44 similarly branches. The ends of the air tube enter the inflatable chambers at their upper end through one-way valves 53. These one-way valves 53 may be heat-welded or similarly sealed to the inflatable chamber 32 to ensure that there is no malfunction. The air tube 43 and the protective tube 44 should be long enough to reach the chambers with enough extra material to withstand any extra pull at activation while the mouthpiece is anchored on the "leg" portion of the present invention. The mouthpiece 42 of the manual inflating attachment and the optional whistle 46 are located at the lower end of the air tube 43, where they are secured to the leg portion 27 (not shown) of the present invention.

FIG. 4(*c*) provides an illustration of a view of the whistle/mouthpiece combination. The mouthpiece 42 and optional whistle 46 are enclosed in a casing 48 to protect them and keep them clean or free from debris. This casing may be of any material, but plastic is suggested for its lightweight yet strong properties. The casing 48 has a plurality of caps 47 which allow the user to access either the whistle, the mouthpiece, or both. The air tube (shown in protective tube 44) is secured to the casing 48 through a one-way airtight seal similar to seal 53.

Figure 5:
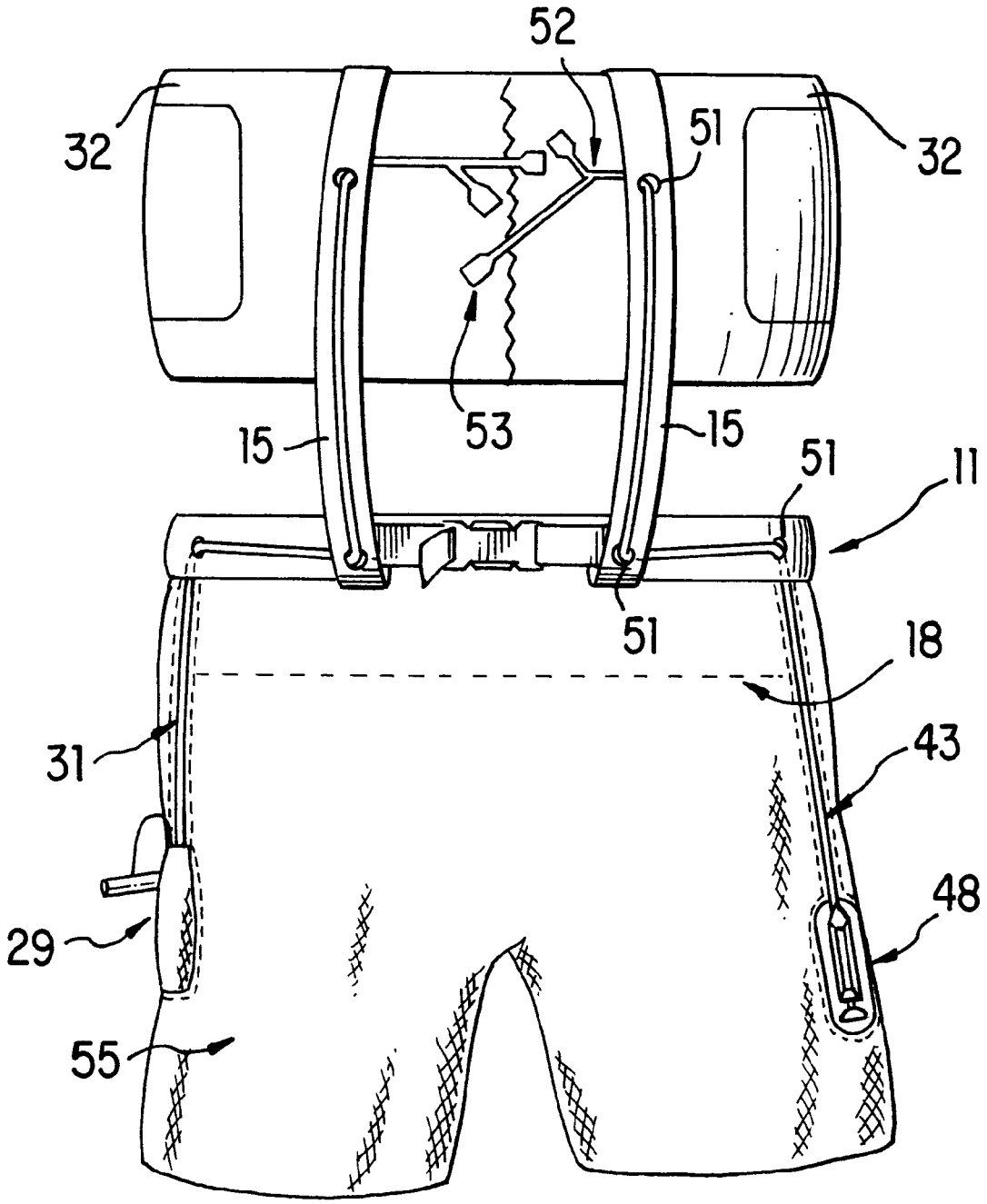
FIG. 5 provides an inflated view of the present invention.

FIG. 5 provides an inflated view of the present invention in which the inflatable portion is separated into two chambers 32 at the portions of the chest and back that are approximately half way between the user's shoulders (only the front portion shown). These chambers 32 may be joined to each other by any means as are known in the art. The gas tube 31 and air tube 43 run from the lower portion of the invention to the inflatable chambers generally along the same path as the straps 15 that run along the users chest. They may run also inside the straps. In order for the gas tube 31 and air tube 43 to reach both chambers 32, the straps 15 that are on the portion of the invention that is to the front of the user each have several small holes 51 through which the tubes extend on their route to the middle of the user's torso. The air tube 43 and the gas tube 31 each "fork" or branch at 52 such that they may inflate both chambers at the same time and in the same amount. The second tubes 33 and 44 similarly branch. There is a one-way valve (not shown) at each point where a tube enters a chamber to ensure that a properly functioning chamber will remain inflated and not be affected by any subsequent disruption or loss of pressure in the inflating system. There is also a seal 53 around each air or gas tube as they enter their chamber to ensure that the chamber inflates properly and does not lose air or gas.

Figure 6:
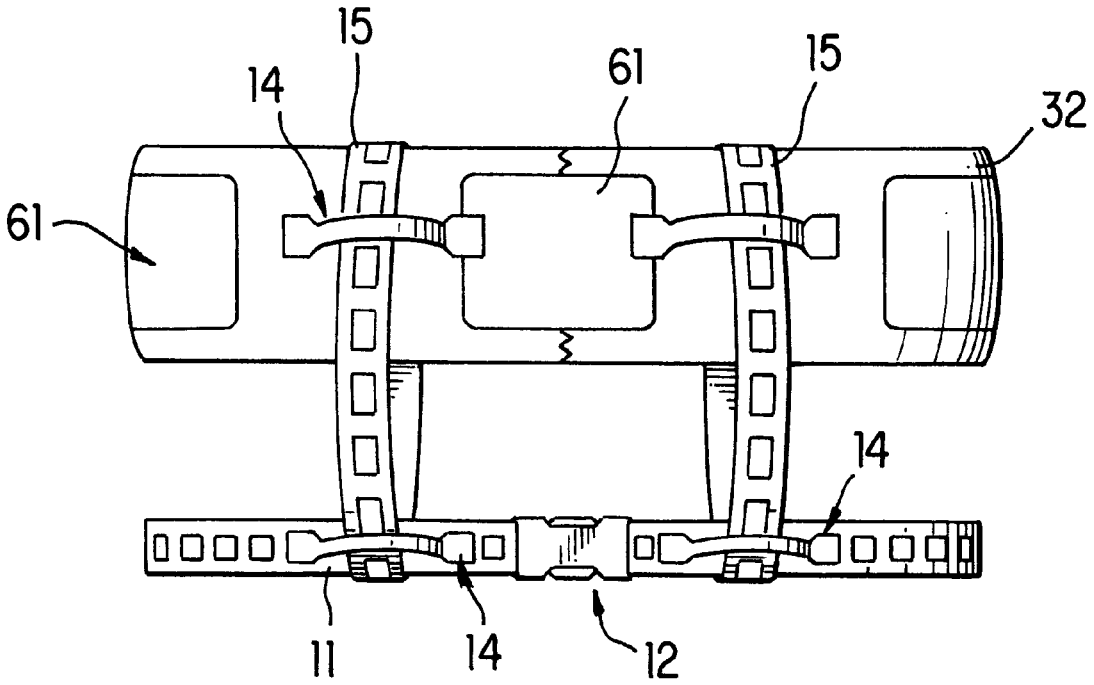
FIG. 6 illustrates an additional safety feature of the present invention: airtight patches.

As shown in FIG. 6, in one embodiment of the present invention, there is a patch 61 which covers the area in which the air tubes 43 and the gas tubes 31 enter the inflatable chambers 32. The patch may be heat sealed, glued, or otherwise joined with the inflatable chambers in an airtight manner. As a further means of protection, there may be an additional, similar patch that substantially covers this first patch 61. It is preferable if the lengths of air tube 43 and gas tube 31 which run from the straps 15 to the valves 53 where they enter the inflatable chambers 32 are completely protected by such patch. The outermost patch may be reflective or brightly colored in order to attract attention to the user and facilitate rescue.

In an alternate embodiment of the present invention (not shown), there may be a patch on the inside of the inflatable chambers that covers any surfaces that may irritate the skin of the wearer after the invention has been inflated.

Figure 7A:
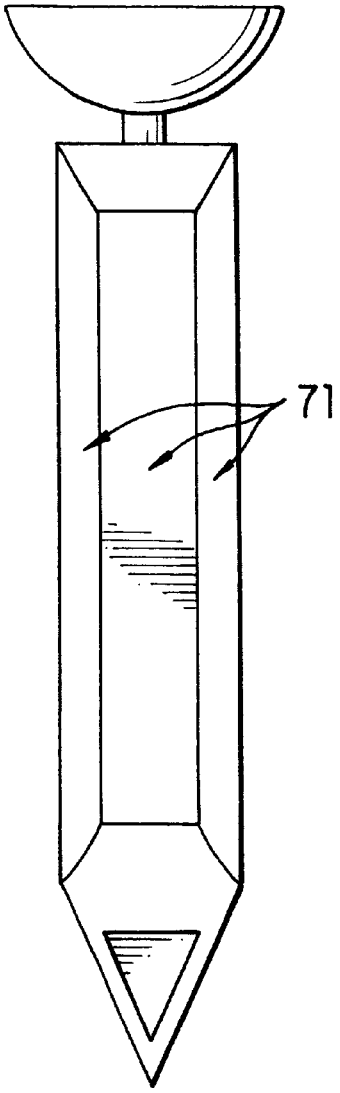
FIGS. 7(*a*) and 7(*b*) show top and side views, respectively, of an embodiment of the manual inflatable mouthpiece and whistle.
Figure 7B:
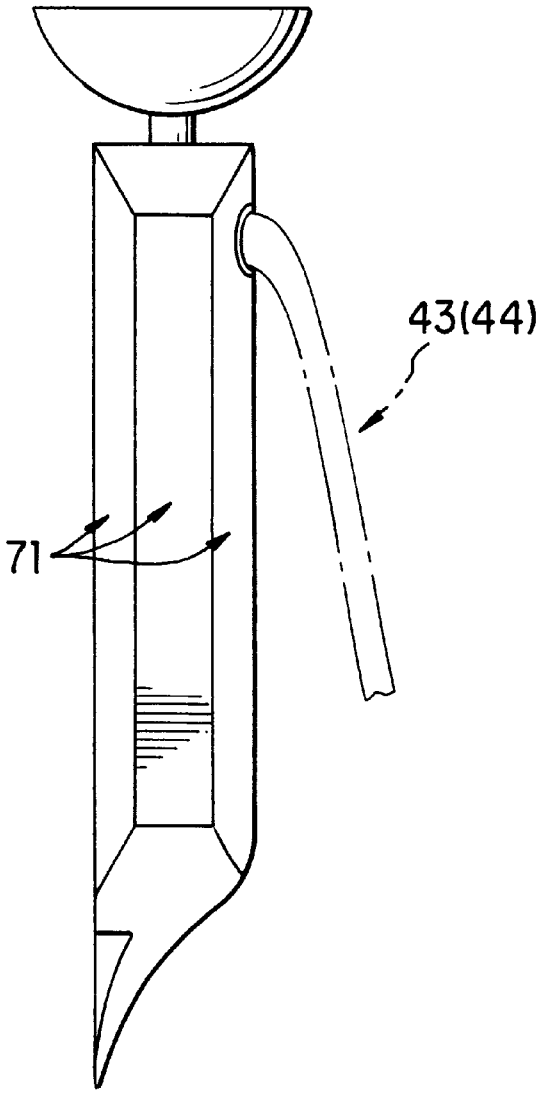
Figure 8A:
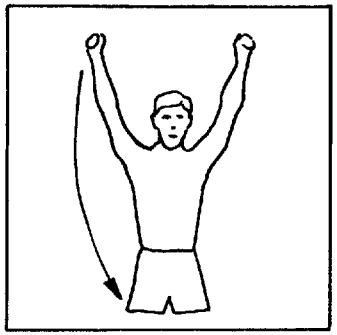
FIGS. 8(*a*)–8(*f*) show various illustrations that could be provided as instructions for the present invention.
Figure 8B:
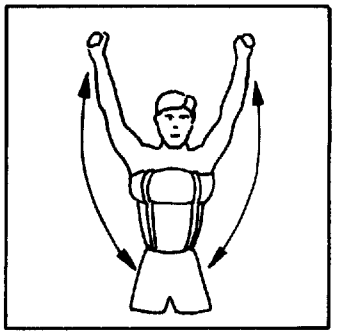
Figure 8C:
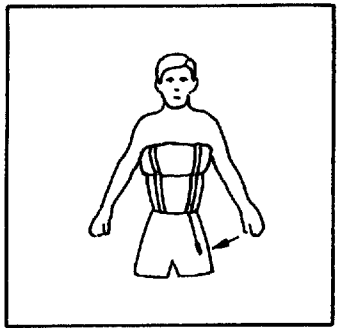
Figure 8D:
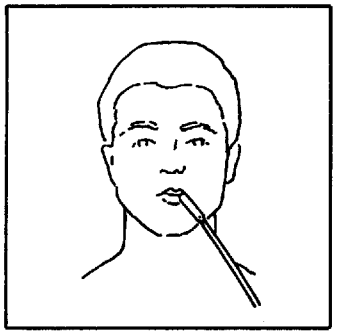
Figure 8E:
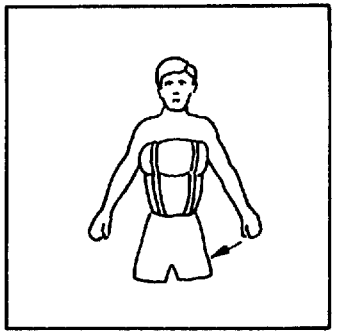
Figure 8F:
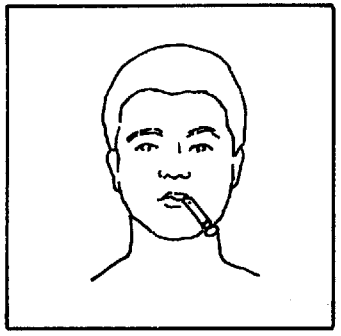

FIGS. 7(*a*) and 7(*b*) show a top and side view, respectively, of one embodiment of the manual inflatable mouthpiece 42 and whistle portion 46 of the present invention. There is a reflecting member 71 running along and encircling the body of the manual inflatable valve and whistle portion of the invention. This reflecting member 71 may take the form of an unbreakable mirror or any other reflecting device. The reflecting member 71 is shown in this embodiment of the invention as being hexagonal, but it should be understood that any shape which provides adequate reflection. The reflecting member may also be in the form of a pyramid so that it reflects light in all directions.

FIGS. 8(*a*)–8(*f*) present an enlarged view of directions which may be printed on the inside portion of the belt or body of the present invention. While these figures will suffice for directions, it should be understood that many other depictions, which may be more or less detailed, could also suffice.

FIG. 8(*a*) shows that the wearer reaches to his right leg in order to pull the rip cord and activate the present invention. The inflatable chambers will rise through the water to rest under the user's raised arms. FIG. 8(*b*) shows that the user may have his arms up or down when the present invention is activated. FIG. 8(*c*) shows that the user may reach the manual inflation tube on his left leg. FIG. 8(*d*) shows that the user may blow in the emergency manual inflation tube in the case of the malfunction of one of the chambers. FIG. 8(*d*) shows that the user of the inflated version of the invention can reach a whistle to attract attention or assistance that is located on his left leg. FIG. 8(*e*) shows the user blowing on this whistle. While the directions may be written, they may also be depicted in the form of pictures so as to be more easily understood.

In one embodiment of the present invention, the rip cord and air canister are located on one "leg" of the invention, while the whistle and manual inflation tube should be located on the other. It should be noted that, for convenience in description, and because most people are right handed, the invention is described as having the air canister on the right and the whistle and manual inflation tube on the left. However, the present invention may be constructed with the manual inflation apparatus on either the left or right, the gas canister on either the left or right, or both on either leg.

The present invention has several safety features built into its design. First, the inflatable portion of the present invention is composed of at least two separate chambers such that the invention will provide flotational support in case of a malfunction by one of the chambers. In one embodiment of the present invention, these chambers meet on the front and back of the torso at the position that is approximately half of the distance between the user's shoulders. In case of a malfunction in the discharge of the compressed gas, the user can hold onto the inflated chamber with one arm and reach the manual inflation tube with the other arm. If the chambers were positioned such that they separated at the sides of the user's body, the user's head could be caused to be pushed either forward or back. This would be detrimental in the typical emergency situation, when the user is struggling to keep their head above water.

Another safety feature is the durable patches 61 which cover the area in which the air and gas tubes enter the inflatable portion 32 and protect the seal between the tubes and the chambers where the tubes enter the chambers. Since the patches are preferably airtight, they also provide a defense in the case of a leak in the one-way valve or the seal. In this manner, air will be prevented from escaping into the environment from this location.

The manual inflation tube is an additional safety feature. In case of a malfunction with the gas canister, the user may blow into the manual inflation valve, which is located within easy reach of their left hand. While being a slower form of inflation, it would still provide the user with flotational support. This valve would also be beneficial in the case of a slow leak. If the user was floating for a longer period of time and a slow leak developed, the user could counteract this through manual inflation.

Another safety feature is the placement of the compressed gas canister. If the canister ruptures, it can cause damage to the area surrounding it. Many flotation devices which use compressed gas canisters locate the canister on the torso of the user. In the case of a malfunction of the canister or cartridge mechanism, the placement of the canister on the user's leg is preferable since the thigh contains fewer vital organs than the torso.

A further safety feature is a whistle that is attached within easy reach of the user's hand. The whistle may be single-toned or play multiple notes. This will permit the users to attract attention to themselves.

The reflecting member 71 is a safety feature that may be used to attract attention to the user. It will reflect light in all directions, so it may attract attention to the user even if the user does not see the potential rescuer. This may also be utilized by the user to attract attention if the user is too tired to blow on the whistle.

The inflatable chambers of the present invention may be brightly colored in order to stand out against a watery background. The bright colors would also make the victim stand out against other backgrounds, like the brush of the shoreline. Reflective or neon patches or tape 61 placed on other surfaces of the present invention would similarly facilitate a rescuer's search.

Once activated, the safety device of the present invention cannot be reused by the wearer unless the re-packed and certified by the factory. There, the chambers are deflated and the canister of compressed gas is replaced. This ensures that the inflatable chambers and tubes are correctly packed in the envelope portion and that the safety device is in working order. Further, it prevents human error by those who are not trained to handle the preparation of the present invention from affecting the performance of the invention.

A depth valve or sensor gauge may be incorporated into the present invention such that if the user is pulled underwater to a predetermined depth (15 feet, for example), the increased pressure from the water would trigger the safety mechanism and cause the present invention to inflate, thus bringing the user to the surface. This could occur if the user was snorkeling and was caught in an underwater current. Alternatively, the user could be surfing, fall, potentially even hit his head, and be pulled under by a wave.

Preferably, the depth valve could be adjusted at the factory to pre-determined depths that are shallower for the novice and deeper for the more advanced swimmer. Thus, the present invention would allow people who are inexperienced with the water to be more comfortable, yet not inconvenience those who are more experienced with an early discharge.

Another benefit of the depth valve is that it could bring the bodies of drowned victims to the surface for easier location.

The present invention is designed so that it is comfortable and able to be worn for long periods of time. As such, the discomfort that is usually a disincentive for people putting on bulky and uncomfortable inflatable life saving devices prior to when they are needed is greatly alleviated. The present invention is sufficiently comfortable such that it may be put on when the user is getting ready to go boating, to the beach or to another activity near or involving water and worn all day. The ease and comfort of wearing the present invention will make it easier for the user to wear it for longer periods of time, making it more likely that the user will be wearing the present invention should any emergency arise.

Proper use of the present invention may be facilitated by printing, embroidering or otherwise placing the instructions for use on the invention within easy view of the user. These could be written or in the form of pictures.

The present invention, when inflated, provides flotational support around the torso of the user. Such support is more stable and secure than other means which tilt or angle the user in the water, since the angling of the user may inhibit swimming or turning motions. Additionally, such support is preferable in an emergency situation to those devices that force the user to hold onto them. In an emergency situation, the user may be panicked or injured. This may cause the user to let go of a detatched inflation device or to allow it to slip from his grasp. In contrast, since the user puts the inflatable portion of the present invention on before the emergency situation arose, he will not have to put it on, grab it or hold onto it in an emergency situation. Once the user activates the present invention by simply pulling on a readily accessible cord, the inflatable chambers of the present invention will rise to rest under the arms of the user. This is beneficial, especially for the tired or injured user.

The fact that the inflatable portions are anchored to the lower portion of the user provides additional security because this prevents the inflatable chambers from slipping over the head of the user. The user may relax, knowing that the inflatable portion will not slip off, even if he relaxes his arms or passes out.

Once the tube is inflated, the user may hold onto either the tube or the straps for a more secure feeling. The straps may also be used as a handhold by a rescuer who is trying to grab hold of the victim or tow them to safety. In the alternative, a rescuer may 'hook' a pole or similar object under the straps to pull the wearer to safety.

The belt closing mechanism may be designed to make a clicking or snapping noise. This will provide the user with audio assurance that the present invention is being worn properly.

The inflatable chambers, while preferably annular, may be U-shaped, half-round, rectangular, spherical or any other shape which is suitable for providing similar flotational support.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein.

What is claimed is:

1. An inflatable safety device, the device comprising:

an article of clothing;

at least one pocket, wherein the pocket is incorporated in the waist and hip area of an article of clothing;

at least two inflatable chambers contained within the pocket;

a releasable member for closing the pocket such that, when inflated, the inflatable chambers may be released from the pocket;

a belt;

fastener for fastening the belt around the waist of a wearer;

a plurality of straps running from said inflatable chamber to said belt;

a compressed gas container;

a first tube running from said gas container to the inflatable chambers;

a mouthpiece;

a second tube running from the mouthpiece to the inflatable chambers; and a ripcord attached to the gas container such that when the ripcord is pulled, the gas is released from the canister and flows through the first tube and into the inflatable chambers, whereby the inflatable chambers are released from the pocket and float so that they rest under the arms and around the torso of the user, and wherein the inflatable chambers carry one end of the straps from the waist of the wearer so that the straps extend substantially vertically along the body of the wearer when the tube is inflated.

2. The device as in claim 1, wherein the device may be worn as an item of apparel selected from the group consisting of: a man's swimsuit, a woman's swimsuit, shorts, skorts and pants.

3. The device as in claim 1, wherein the shape of an inflatable chamber is selected from the group consisting of: oblong, L-shaped and annular.

4. The device as in claim 1, including a fastener to hold the inflatable chambers around the wearer in a shape suitable for supporting the body of the wearer.

5. The device as in claim 1, wherein the straps are constructed from a durable, flexible material.

6. The device as in claim 1, wherein the straps have a first and a second end, and wherein the first end is attached to the inflatable chamber and the second end is attached to the belt.

7. The device as in claim 1, wherein the straps run through safeguards attached to an inflatable chamber.

8. The device as in claim 1, wherein the first and second tubes pass through one-way airtight valves as they enter the inflatable chambers.

9. The device as in claim 1, further including tubing surrounding each of the first and second tubes.

10. The device as in claim 1, including a detachable band that holds the ripcord and handle to the portion of the device that covers a portion of the wearer's thigh.

11. The device as in claim 1, wherein the gas container is located in the portion of the article that covers a portion of the wearer's thigh.

12. The device as in claim 1, wherein the releasing member for closing the pocket is selected from the group consisting of corresponding hook and loop fasteners and snaps.

13. The device as in claim 1, wherein the mouthpiece is attached to a leg portion of the article of clothing.

14. The device as in claim 1, wherein the inflatable chambers have safety devices features selected from the group consisting of: brightly colored tubing material, brightly colored patches, brightly colored tape, neon tape, neon patches, reflective tape, reflective patches, a reflective member and a combination thereof.

15. The device as in claim 1, wherein the device may be worn as an item of apparel selected from the group consisting of: a wetsuit and a drysuit.

16. An inflatable safety device, the device comprising:

an article of clothing;

at least one pocket, wherein the pocket is incorporated in the waist and hip area of an article of clothing;

at least two inflatable chambers contained within the pocket;

a releasable member for closing the pocket such that, when inflated, the inflatable chambers may be released from the pocket;

a belt;

fastener for fastening the belt around the waist of a wearer;

a plurality of straps running from said inflatable chamber to said belt;

a compressed gas container;

a first tube running from said gas container to the inflatable chambers;

a one-way, airtight valve located so that the gas from the gas container passes through the valve as it enters an inflatable chamber;

a mouthpiece;

a second tube running from the mouthpiece to the inflatable chambers a one-way, airtight valve located so that air from the mouthpiece passes through the valve as it enters an inflatable chamber; and a ripcord attached to the gas container such that when the ripcord is pulled, the gas is released from the canister and flows through the first tube and into the inflatable chambers, whereby the inflatable chambers are released from the pocket and float so that they rest under the arms and around the torso of the user, and wherein the inflatable chambers carry one end of the straps from the waist of the wearer so that the straps extend substantially vertically along the body of the wearer when the tube is inflated.

17. An inflatable safety device, the device comprising:

an article of clothing;

at least one pocket, wherein the pocket is incorporated in the waist and hip area of an article of clothing;

at least two inflatable chambers contained within the pocket;

a releasable member for closing the pocket such that, when inflated, the inflatable chambers may be released from the pocket;

a belt;

fastener for fastening the belt around the waist of a wearer;

a plurality of straps running from said inflatable chamber to said belt;

a compressed gas container;

a first tube running from said gas container to the inflatable chambers;

a mouthpiece;

a second tube running from the mouthpiece to the inflatable chambers;

tubing surrounding the first and the second tube; and a ripcord attached to the gas container such that when the ripcord is pulled, the gas is released from the canister and flows through the first tube and into the inflatable chambers, whereby the inflatable chambers are released from the pocket and float so that they rest under the arms and around the torso of the user, and wherein the inflatable chambers carry one end of the straps from the waist of the wearer so that the straps extend substantially vertically along the body of the wearer when the tube is inflated.

18. An inflatable safety device, the device comprising:

an article of clothing;

at least one pocket, wherein the pocket is incorporated in the waist and hip area of an article of clothing;

at least two inflatable chambers contained within the pocket;

a releasable member for closing the pocket such that, when inflated, the inflatable chambers may be released from the pocket;

a belt;

fastener for fastening the belt around the waist of a wearer;

a plurality of straps running from said inflatable chamber to said belt;

a compressed gas container;

a first tube running from said gas container to the inflatable chambers;

a mouthpiece;

a second tube running from the mouthpiece to the inflatable chambers;

a ripcord attached to the gas container; and a detachable band holding the ripcord and handle to the portion of the device that covers a portion of the wearer's thigh, wherein the pulling of the ripcord releases gas from the canister that flows through the first tube and into the inflatable chambers, whereby the inflatable chambers are released from the pocket and float so that they rest under the arms and around the torso of the user, and wherein the inflatable chambers carry one end of the straps from the waist of the wearer so that the straps extend substantially vertically along the body of the wearer when the tube is inflated.

19. An inflatable safety device, the device comprising:

an article of clothing;

at least one pocket, wherein the pocket is incorporated in the waist and hip area of an article of clothing;

at least two inflatable chambers contained within the pocket;

a releasable member for closing the pocket such that, when inflated, the inflatable chambers may be released from the pocket;

a belt;

fastener for fastening the belt around the waist of a wearer;

a plurality of straps running from said inflatable chamber to said belt;

a compressed gas container located in the portion of the article that covers a portion of the wearer's thigh;

a first tube running from said gas container to the inflatable chambers;

a mouthpiece;

a second tube running from the mouthpiece to the inflatable chambers; and a ripcord attached to the gas container such that when the ripcord is pulled, the gas is released from the canister and flows through the first tube and into the inflatable chambers, whereby the inflatable chambers are released from the pocket and float so that they rest under the arms and around the torso of the user, and wherein the inflatable chambers carry one end of the straps from the waist of the wearer so that the straps extend substantially vertically along the body of the wearer when the tube is inflated.

20. The device as in claim 1, wherein the releasing member for closing the pocket is light stitching.

21. The device as in claim 17, wherein the device may be worn as an item of apparel selected from the group consisting of: a man's swimsuit, a woman's swimsuit, shorts, skorts and pants.

22. The device as in claim 19, wherein the device may be worn as an item of apparel selected from the group consisting of: a man's swimsuit, a woman's swimsuit, shorts, skorts and pants.

23. The device as in claim 21, wherein the device may be worn as an item of apparel selected from the group consisting of: a man's swimsuit, a woman's swimsuit, shorts, skorts and pants.

24. The device as in claim 23, wherein the device may be worn as an item of apparel selected from the group consisting of: a man's swimsuit, a woman's swimsuit, shorts, skorts and pants.

* * * * *